US007284950B2

(12) United States Patent
Narisako et al.

(10) Patent No.: US 7,284,950 B2
(45) Date of Patent: Oct. 23, 2007

(54) IMPELLER AND APPARATUS USING THE SAME

(75) Inventors: Hideki Narisako, Kariya (JP); Tadashi Hazama, Chita-gun (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 11/290,417

(22) Filed: Dec. 1, 2005

(65) Prior Publication Data

US 2006/0120853 A1 Jun. 8, 2006

(30) Foreign Application Priority Data

Dec. 8, 2004 (JP) ..... 2004-355609

(51) Int. Cl.
*F04D 5/00* (2006.01)

(52) U.S. Cl. ..... 415/55.1; 416/203

(58) Field of Classification Search ..... 415/55.1, 415/55.2, 55.3, 55.4, 55.5, 55.6, 55.7; 417/423.3; 416/203

See application file for complete search history.

(56) References Cited

U.S. PATENT DOCUMENTS

| | | | | |
|---|---|---|---|---|
| 6,471,466 | B2 * | 10/2002 | Marx et al. | 415/55.1 |
| 6,767,179 | B2 | 7/2004 | Kusagaya et al. | |
| 2003/0026685 | A1 * | 2/2003 | Takagi et al. | 415/55.1 |
| 2003/0026686 | A1 * | 2/2003 | Kusagaya et al. | 415/55.1 |
| 2004/0223841 | A1 * | 11/2004 | Yu et al. | 415/55.1 |

* cited by examiner

*Primary Examiner*—Richard A. Edgar
(74) *Attorney, Agent, or Firm*—Nixon & Vanderhye PC

(57) ABSTRACT

An impeller rotates for pressurizing fluid in a pump passage. The impeller includes an inner circumferential portion and an outer circumferential portion. The outer circumferential portion has two axial end surfaces that respectively have a plurality of vane grooves arranged in a rotative direction of the outer circumferential portion. A plurality of communication holes axially penetrates one of the inner circumferential portion and the outer circumferential portion. The plurality of communication holes is displaced from the plurality of vane grooves in a radial direction of the outer circumferential portion. The plurality of communication holes is arranged substantially along the rotative direction of the outer circumferential portion at nonuniform pitches.

11 Claims, 5 Drawing Sheets

IMPELLER AND APPARATUS USING THE SAME

CROSS REFERENCE TO RELATED APPLICATIONS

This application is based on and incorporates herein by reference Japanese Patent Application No. 2004-355609 filed on Dec. 8, 2004.

FIELD OF THE INVENTION

The present invention relates to an impeller having vane grooves on the outer circumferential periphery thereof, and an apparatus using the impeller.

BACKGROUND OF THE INVENTION

According to JP-A-2003-336558 (U.S. Pat. No. 6,767,179 B2), a fuel pump includes an impeller having vane grooves in the outer circumferential periphery of the impeller. The impeller rotates in the fuel pump, so that the fuel pump pumps fuel. Specifically, as shown in FIGS. 6A, 6B, an impeller 300 has end surfaces with respect to the direction of the rotation axis thereof. The end surfaces of the impeller 300 respectively have vane grooves 302, 304. The impeller 300 has communication holes 306 on the side of the inner circumferential periphery of the vane grooves 302, 304. The communication holes 306 axially penetrate the impeller 300. Pump passages are formed on both sides of the impeller 300 with respect to the axial direction of the impeller 300.

The pump passages respectively extend along the vane grooves 302, 304. When the impeller 300 rotates, fuel is respectively pressurized in the pump passages on both sides relative to the rotative direction. Fuel, which is in the pump passage on one axial side, passes through the communication holes of the impeller, so that the fuel flows together with fuel in the pump passage on the other axial side, thereby being discharged from the outlet of the pump passage.

In this structure, when the impeller 300 rotates, and fuel is pressurized in the pump passages using the vane grooves 302, 304, pressure fluctuation arises in fuel at a frequency $\upsilon$ that is calculated by the following formula.

$$\upsilon = (\text{number of the vane grooves}) \times (\text{rotation speed of the impeller}).$$

As shown in FIG. 7, noise arises at a frequency the corresponding to the pressure fluctuation. The vane grooves 302, 304, which are formed on both sides of the axial end surfaces of the impeller 300, are displaced from each other for a half pitch thereof along the rotative direction. Therefore, in FIG. 7, the distribution of the noise has two peaks. Specifically, another peak arises in the distribution of the noise at particular frequency, which is twice as the other frequency.

SUMMARY OF THE INVENTION

In view of the foregoing and other problems, it is an object of the present invention to produce an impeller that is capable of reducing noise, and to produce an apparatus using the impeller.

According to one aspect of the present invention, an impeller rotates for pressurizing fluid in a pump passage. The impeller includes an inner circumferential portion and an outer circumferential portion. The outer circumferential portion connects to the inner circumferential portion from a radially outer side of the inner circumferential portion. The outer circumferential portion has two axial end surfaces with respect to an axial direction of the outer circumferential portion. Each of the two axial end surfaces has a plurality of vane grooves arranged in a rotative direction of the outer circumferential portion. One of the inner circumferential portion and the outer circumferential portion has a plurality of communication holes. Each of the plurality of communication holes penetrating the one of the inner circumferential portion and the outer circumferential portion substantially in the axial direction of the outer circumferential portion. The plurality of communication holes is displaced from the plurality of vane grooves in a radial direction of the outer circumferential portion. The plurality of communication holes is arranged substantially along the rotative direction of the outer circumferential portion at nonuniform pitches.

A fuel pump includes the impeller and a casing member. The casing member rotatably accommodates the impeller. The casing member has a fuel inlet, a fuel outlet, and pump passages. Each of the pump passages extends from the fuel inlet to the fuel outlet. The pump passages are arranged on both sides of the two axial end surfaces of the outer circumferential portion. The pump passages respectively extend along the plurality of the vane grooves substantially in the rotative direction. The impeller rotates for pumping fuel from the fuel inlet to the fuel outlet through the pump passages, in which fuel is pressurized. Fuel passes from one of the pump passages to an other of the pump passages through the plurality of communication holes of the impeller on the side of the fuel outlet in the pump passages.

Alternatively, an impeller apparatus includes an impeller and a casing member. The impeller has an outer circumferential portion that has two axial end surfaces with respect to an axial direction of the impeller. Each axial end surface of the outer circumferential portion has a plurality of vane grooves that is arranged in a rotative direction of the impeller. The impeller has a plurality of communication holes that penetrates the impeller substantially in the axial direction of the impeller. The plurality of communication holes is displaced from the plurality of vane grooves in a radial direction of the impeller. The plurality of communication holes is arranged substantially along the rotative direction of the impeller at nonuniform pitches. The casing member rotatably accommodates the impeller. The casing member has pump passages. One pump passage opposes to one of the two axial end surfaces of the outer circumferential portion in the axial direction of the impeller. An other pump passage opposes to an other of the two axial end surfaces of the outer circumferential portion in the axial direction of the impeller. The pump passages respectively extend from an inlet to an outlet in the casing member along the plurality of the vane grooves substantially in the rotative direction of the impeller.

Thus, in this structure, the cycle of pressure fluctuation in fluid, which flows together on the other side of the vane grooves, varies, so that a peak can be restricted from arising in noise at a particular frequency, so that the noise level can be reduced in the impeller.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

First Embodiment

Figure 1:
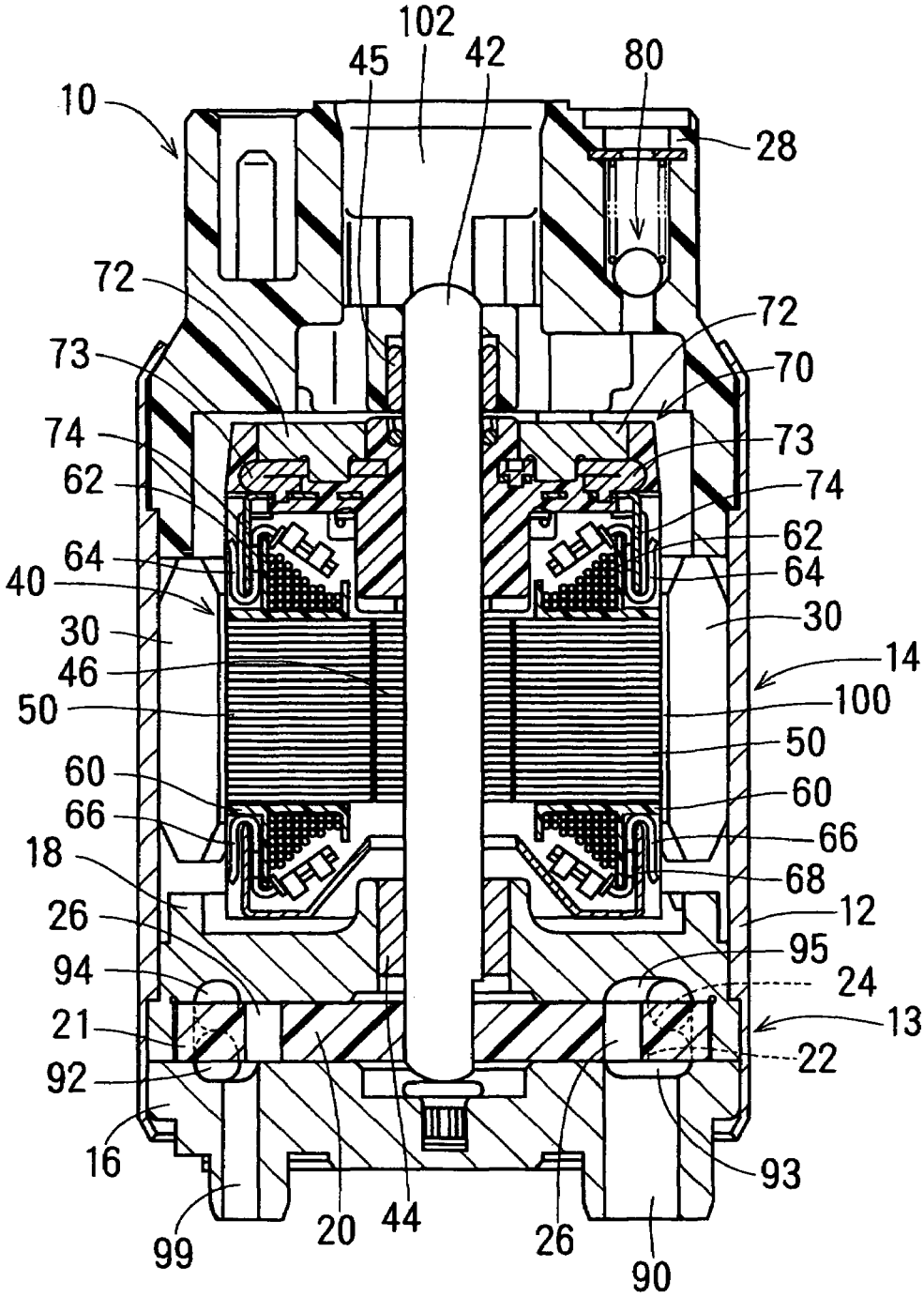
FIG. 1 is a partially cross sectional side view showing a fuel pump including an impeller, according to a first embodiment of the present invention.

As shown in FIG. 1, a fuel pump 10 is an in-tank pump, for example. The fuel pump 10 is provided in a fuel tank of a vehicle, or the like. The fuel pump 10 includes a pump portion 13, a motor portion 14, and an end cover 28. The motor portion 14 rotates an impeller (impeller body) 20 of the pump portion 13. The housing 12 surrounds the outer circumferential periphery of both the pump portion 13 and the motor portion 14, so that the housing 12 serves a housing, which commonly accommodates both inner components of the pump portion 13 and the motor portion 14. An end cover 28 covers the housing 12 on the opposite side of the pump portion 13 with respect to the motor portion 14. The end cover 28 has a discharge port 102.

The pump portion 13 is a Wesco type pump, for example. The pump portion 13 includes a pump cover 16, a pump casing 18, and the impeller 20. The pump cover 16 and the pump casing 18 serve as casing members that rotatably accommodate the impeller 20.

Figure 3A:
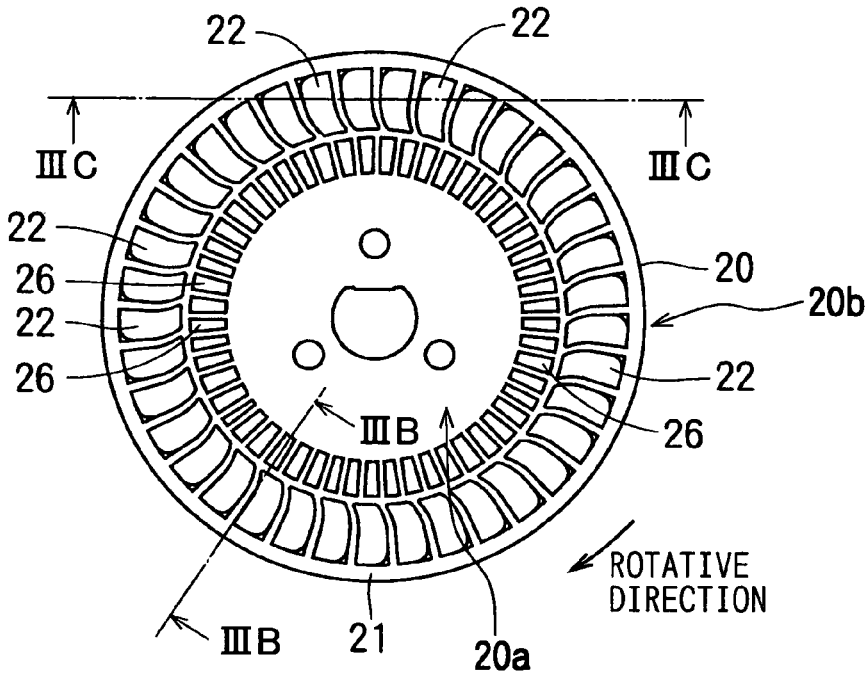
FIG. 3A is a front view showing the impeller when being viewed from the side of a fuel inlet of the fuel pump.
Figure 3B:
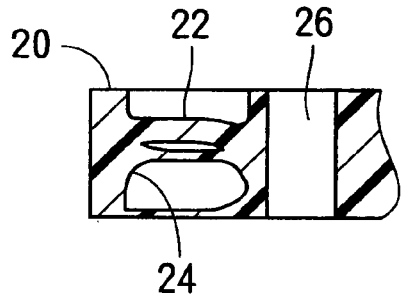
FIG. 3B is a cross sectional side view taken along the line IIIB in FIG. 3A.
Figure 3C:
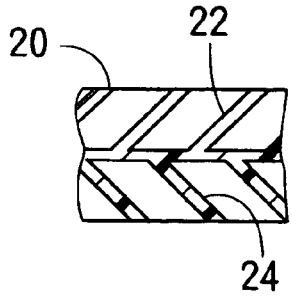
FIG. 3C is a cross sectional side view taken along the line IIIC-IIIC in FIG. 3A, according to the first embodiment.

As shown in FIGS. 3A to 3C, the impeller 20 is formed in a disc shape. The impeller 20 serves as a rotative member.

The impeller 20 has the outer circumferential periphery that has both axial end surfaces relative to the rotation axis. Both the axial end surfaces of the impeller 20 respectively have vane grooves 22, 24. The number of the vane grooves 22 is the same as the number of the vane grooves 24. The impeller 20 has an annular portion 21, which is formed on the radially outer side of the vane grooves 22, 24, such that the annular portion 21 circumferentially surrounds the vane grooves 22, 24. The impeller 20 has the outer diameter that is between 25 mm and 35 mm, for example. The impeller 20 has the thickness that is between 3 mm and 4 mm, for example. The vane grooves 22, 24 are arranged at substantially regular pitches (intervals) along the rotative direction of the impeller 20. That is, the vane grooves 22, 24 respectively have the width along the rotative direction of the impeller 20. This width of the vane grooves 22, 24 are substantially constant among the vane grooves 22, 24. The vane grooves 22 and the vane grooves 24 are in a staggered arrangement such that each vane groove 22 is displaced to the corresponding vane groove 24 along the rotative direction thereof for a half pitch thereof. Therefore, each vane groove 22 is partitioned from the corresponding vane groove 24, so that fuel does not communicate between each vane groove 22 and the corresponding vane groove 24. The pump cover 16 has a pump passage 92 (FIG. 1) in the rotative direction along the vane grooves 22 of the impeller 20. The pump casing 18 has a pump passage 94 in the rotative direction along the vane grooves 24 of the impeller 20.

Alternatively, in the above structure, the impeller 20 includes an inner circumferential portion 20*a* and an outer circumferential portion 20*b*. The outer circumferential portion 20*b* connects to the inner circumferential portion 20*a* from the radially outer side of the inner circumferential portion 20*a*. The outer circumferential portion 20*b* has the two axial end surfaces with respect to the axial direction of the outer circumferential portion 20*b*. Each of the two axial end surfaces has the multiple vane grooves 22, 24 arranged in the rotative direction of the outer circumferential portion.

The impeller 20 has multiple communication holes 26 in the vicinity of the inner circumferential peripheries of the vane grooves 22, 24. The communication holes 26 respectively penetrate the impeller 20 substantially along the rotation axis of the impeller 20. The communication holes 26 are arranged at nonuniform pitches (irregular intervals) along the rotative direction. The communication hole 26 in the region (large-pitch region), in which the pitch is large, has the first width relative to the rotative direction. The communication hole 26 in the region (small-pitch region), in which the pitch is small, has the second width relative to the rotative direction. The first width of the communication hole 26 in the large-pitch region is larger than the second width of the communication hole 26 of the communication hole 26 in the small-pitch region. The number of the communication holes 26 is greater than the number of the vane grooves 22 or the number of the vane grooves 24.

As referred to FIG. 1, fuel is drawn from a fuel inlet 90 of the pump cover 16 by rotation of the impeller 20. The fuel repeatedly flows out of the vane grooves 22, 24 of the impeller 20 and repeatedly flows into the vane grooves 22, 24, so that the fuel generates a swirling flow. Fuel in the pump passages 92, 94 is pressurized by energy of the swirling flow. The fuel pressurized in the pump passages 92, 94 flows out of a fuel outlet 98 (FIG. 2) of the pump casing 18, and the fuel flows through a fuel passage 100 formed between the inner circumferential peripheries of permanent magnets 30 and the outer circumferential periphery of an armature 40. The fuel is discharged from the discharge port 102 formed in the end cover 28, after passing through the fuel passage 100. Discharge pressure of the fuel pump 10 is between 250 kPa and 500 kPa, for example. The rotation speed of the impeller 20 is between 4000 rpm and 7000 rpm, for example. An amount of fuel discharged from the fuel pump 10 is substantially in proportion to the rotation speed of the impeller 20, and is between 50 L/h and 200 L/h, for example.

The pump passages 92, 94 are individually formed on both axial sides of the impeller 20 relative to the rotation axis. Each of the pump passages 92, 94 are respectively formed in substantially C-shapes. The pump passage 92 is formed on the side of the fuel inlet 90 with respect to the impeller 20. The pump passage 94 is formed on the side of the fuel outlet 98 (FIG. 2) of the pump casing 18 with respect to the impeller 20. The pump passages 92, 94 respectively communicate with the vane grooves 22, 24 formed on both axial sides of the impeller 20. Here, the pump passages 92, 94 are formed on both axial sides of the impeller 20, and are not formed in the outer circumferential periphery of the impeller 20. The outer circumferential periphery of the impeller 20 and the inner circumferential periphery of the pump casing 18 form a small clearance therebetween, so that the impeller 20 can smoothly slide relatively to the pump casing 18.

Figure 2:
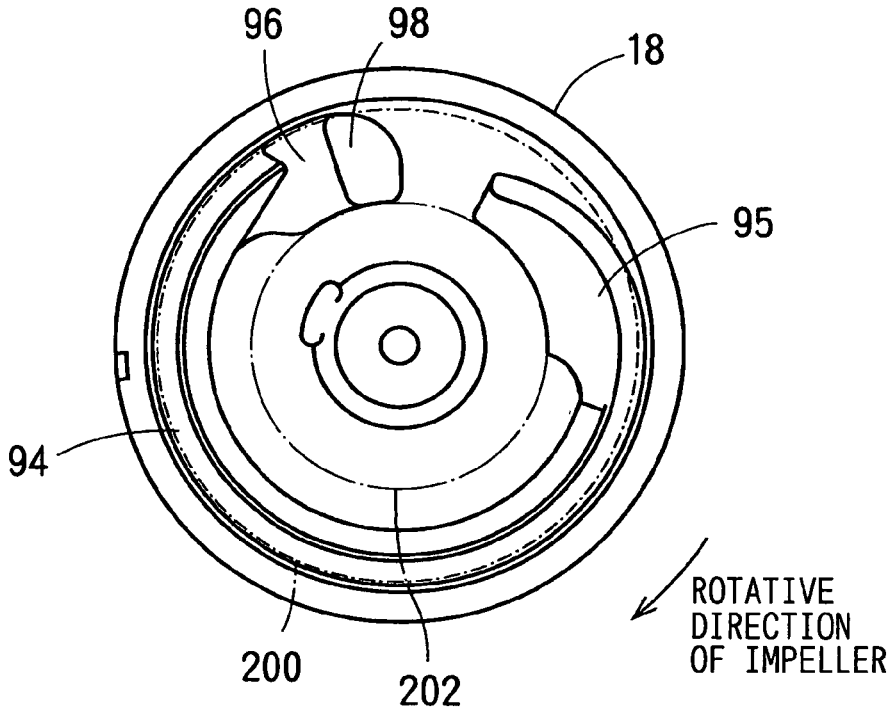
FIG. 2 is a front view showing a pump casing of the fuel pump when being viewed from the side of the impeller according to the first embodiment.

As referred to FIG. 2, the pump passage 94 formed in the pump casing 18 has a start end 95. This start end 95 is radially formed from the vane grooves 24 of the impeller 20 to the communication holes 26, which are on the side of the inner circumferential periphery of the pump passage 94. The start end 95 of the pump passage 94 has the width such that the vane grooves 24 communicate with the communication holes 26 through the start end 95. The pump passage 92 formed in the pump cover 16 has a start end 93 (FIG. 1). This start end 93 is radially formed from the vane grooves 22 to the communication holes 26, which are on the side of the inner circumferential periphery of the pump passage 92. The start end 93 of the pump passage 92 has the width such that the vane grooves 22 communicate with the communication holes 26 through the start end 93.

The pump passage 94 has a tip end 96 that communicates with the fuel outlet 98. The position of the inner circumferential side of the tip end 96 substantially coincides with an inner circumferential position 202 of the communication holes 26 of the impeller 20. The position of the outer circumferential side, i.e., radially outer side of the tip end 96 substantially coincides with an outer circumferential position 200 of the vane grooves 24 of the impeller 20. The tip end 96 is formed radially from the vane grooves 24 of the impeller 20 to the communication holes 26 on the inner circumferential peripheral side of the vane grooves 24 in the impeller 20. Therefore, the tip end 96 communicates with both the vane grooves 24 and the communication holes 26. The pump passage 92 has a tip end (not shown) that smoothly extends from the side of the vane grooves 22 to the communication holes 26 on the side of the inner circumferentially periphery of the vane grooves 22 in the impeller 20. The portion of the pump passage 92 circumferentially between the start end thereof and the tip end thereof is positioned on the side of the outer circumferential periphery of the communication holes 26 of the impeller 20, thereby communicating with only the vane grooves 22.

The portion of the pump passage 94 circumferentially between the start end 95 and the tip end 96 are positioned on the side of the outer circumferential periphery of the communication holes 26 of the impeller 20, thereby communicating with only the vane grooves 24. A vent hole 99 communicates with the pump passage 92, so that air contaminated in fuel in the pump passage 92 is vent to the out of the fuel pump 10 through the vent hole 99.

As referred to FIG. 1, the motor portion 14 is constructed of the permanent magnets 30, the armature 40, and a commutator 70. Each permanent magnet 30 is formed in a shape of a quarter of a circle. The permanent magnets 30 are circumferentially arranged in the inner circumferential periphery of the housing 12. The permanent magnets 30 form four magnetic poles in the rotative direction, such the magnetic poles are different from each other.

The armature 40 has a center core 46 in the rotation center thereof. A shaft 42 is press-inserted into the center core 46. The shaft 42 is supported at both axial ends thereof using bearings 44, 45. The center core 46 is in a substantially cylindrical shape having a substantially hexagonal cross section. Six magnetic cores 50 are arranged on the outer periphery of the magnetic core 50 along the rotative direction. A bobbin 60 engages with each magnetic core 50. A concentrated winding is provided to the outer circumferential periphery of the bobbin 60 to construct a coil 62. The inner circumferential periphery of the magnetic core 50 engages with the outer circumferential periphery of the center core 46.

The end portion of each coil 62 on the side of the commutator 70 electrically connects with a coil terminal 64. The coil terminal 64 engages with a commutator terminal 74 on the side of the commutator 70, thereby electrically connecting with the commutator 70. The end portion of each coil 62 on the side of the impeller 20, i.e., on the opposite side of the commutator 70 electrically connects with each coil terminal 66. Six coil terminals 66 electrically connect with each other via a cover terminal 68. That is, the six coils 62 are star wired.

The commutator 70 is assembled to the axial end of the armature 40 on the opposite side of the impeller 20. The commutator 70 has six segments 72, which are arranged along the rotative direction. Each segment 72 electrically connects with each commutator terminal 74. The segment 72 is formed of a carbon material, for example. The segments 72, which are adjacent to each other in the rotative direction, are electrically insulated. The segment 72 electrically connects with the commutator terminal 74 via an intermediate terminal 73.

A pressure regulating valve 80 opens when pressure in the fuel pump 10 becomes equal to or greater than predetermined pressure, thereby decreasing pressure in the fuel pump 10.

Next, an operation of the fuel pump 10 is described.

The impeller 20 rotates with the armature 40, so that the impeller 20 generates negative pressure in the fuel inlet 90, thereby drawing fuel from the fuel inlet 90 to the start end 93 of the pump passage 92. The start end 93 of the pump passage 92 communicates with both the vane grooves 22 and the communication holes 26. On the axially opposite side, the start end 95 of the pump passage 94 communicates with both the vane grooves 24 and the communication holes 26. Therefore, fuel drawn from the fuel inlet 90 into the start end 93 of the pump passage 92 flows into the start end 95 of the pump passage 94 through the communication holes 26. The impeller 20 rotates, thereby generating swirling flow in the vane grooves 22, 24, and the swirling flows pass into the vane grooves 22, 24 in the backward thereof, in series. This operation is repeated using the large number of the vane grooves 22, 24 provided along the rotative direction, so that swirling flows of fuel is formed in the vane grooves 22, 24 and the pump passages 92, 94, thereby pressurizing fuel. Fuel in the pump passages 92, 94 are individually pressurized from the side of the fuel inlet 90 to the side of the fuel outlet 98.

In the tip end of the pump passage 92, flow direction smoothly changes from the vane grooves 22 to the communication holes 26, which is on the inner circumferential periphery side of the vane grooves 22. Therefore, as the vane grooves 22 are closed in series in the tip end side of the pump passage 92 in the pump cover 16, fuel in the pump passage 92 on the side of the vane groove 22 flows into the communication holes 26 on the side of the inner circumferential periphery. Fuel flowing from the pump passage 92 to the communication holes 26 is guided to the tip end 96 of the pump passage 94 through the communication holes 26. In this situation, fuel in the pump passage 92 and fuel in the pump passage 94 flow together in the tip end 96, so that the fuel is discharged from the fuel outlet 98 to the side of the armature 40.

Figure 4:
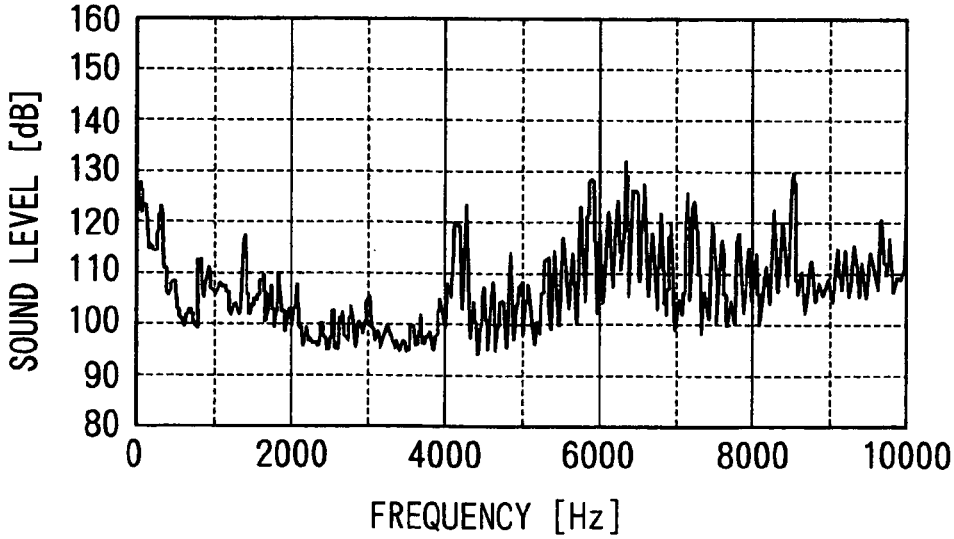
FIG. 4 is a graph showing a relationship between frequency and sound level of the fuel pump.

In this situation, as described above, the communication holes 26 are arranged at the nonuniform pitches (irregular intervals) along the rotative direction. Besides, fuel flows from the pump passage 92 into the tip end 96 of the pump passage 94 through the communication holes 26. Frequency (pressure frequency) of pressure fluctuation in fuel, which flows from the pump passage 92 into the tip end 96 of the pump passage 94, varies. The fuel fluctuating in pressure frequency flows together with fuel, which is pressurized in the pump passage 94 using the vane grooves 24, in the tip end 96, so that a cycle of the pressure fluctuation of fuel varies in the tip end 96. Therefore, as shown in FIG. 4, a level of sound caused due to the pressure fluctuation in fuel can be restricted from becoming large at a particular frequency.

Each vane groove 22 is displaced with respect to the corresponding vane groove 24 in the rotative direction thereof for a half pitch thereof. Therefore, phase of pulsation in pressure of fuel pressurized in the pump passage 92 differs from phase of pulsation in pressure of fuel pressurized in the pump passage 94. Fuel, which is in a phase of pressure pulsation, and fuel, which is in another phase of pressure pulsation, flows together in the tip end 96, so that the fuel flow is merged in the tip end 96. In this situation, one fuel in the pump passage 92 and the other fuel in the pump passage 94 negate pressure pulsation each other. Therefore, the level of sound arising in the fuel pump 10 can be further decreased.

Furthermore, in this embodiment, the number of the communication holes 26 is set greater than one of the number of the groove vanes 22 and the number of the groove vanes 24. That is, the number of the vane grooves is not the total number of the vane grooves 22, 24 formed on both axial end surfaces of the outer circumferential periphery of the impeller 20. The number of the vane grooves is the number of the vane grooves formed on one axial end surface of the impeller 20.

In this structure, frequency of the pressure fluctuation in fuel, which flows together in the pump passage 94, becomes high, compared with a structure, in which the number of the communication holes 26 is the same as the number of the groove vanes 22, 24. Specifically, frequency of the pressure fluctuation in fuel, which is merged in the pump passage 94 on the side of the fuel outlet 98 after passing from the pump passage 92 through the communication holes 26, becomes high. Therefore, frequency of sound arising due to the pressure fluctuation in fuel becomes high. In general, hearing acuity fades, particularly in the high-frequency range. Therefore, when frequency of pressure fluctuation in fuel becomes high, noise level, which is noticeable for human, can be reduced.

In this embodiment, the vane grooves 23, 24 are arranged at substantially regular pitches (intervals) in the rotative direction of the impeller 20, so that swirling flow of fuel respectively pressurized in the pump passages 92, 94 can be restricted from causing disorder. Therefore, the pumping performance of the impeller 20 can be maintained.

In general, when the length, which is from the center of the impeller to the location, in which the groove vanes are formed in the radial direction of the impeller, is the same, and the length of the pump passage extending in the rotative direction along the groove vanes is the same, a pumping performance for pressurizing fuel becomes substantially the same. In the above embodiments, the communication holes are formed on the side of the inner circumferential periphery of the vane grooves. Therefore, when the pumping performance is the same, the impeller can be downsized compared with a structure, in which the communication holes are formed on the side of the outer circumferential periphery of the vane grooves.

When the impeller in the above embodiments is used in a fuel pump, noise arising in the fuel pump can be reduced. Particularly, in an automotive, noise can be restricted from being transmitted from the fuel pump into the passenger compartment, so that silence in the passenger compartment can be preferably enhanced.

Second Embodiment

Figure 5:
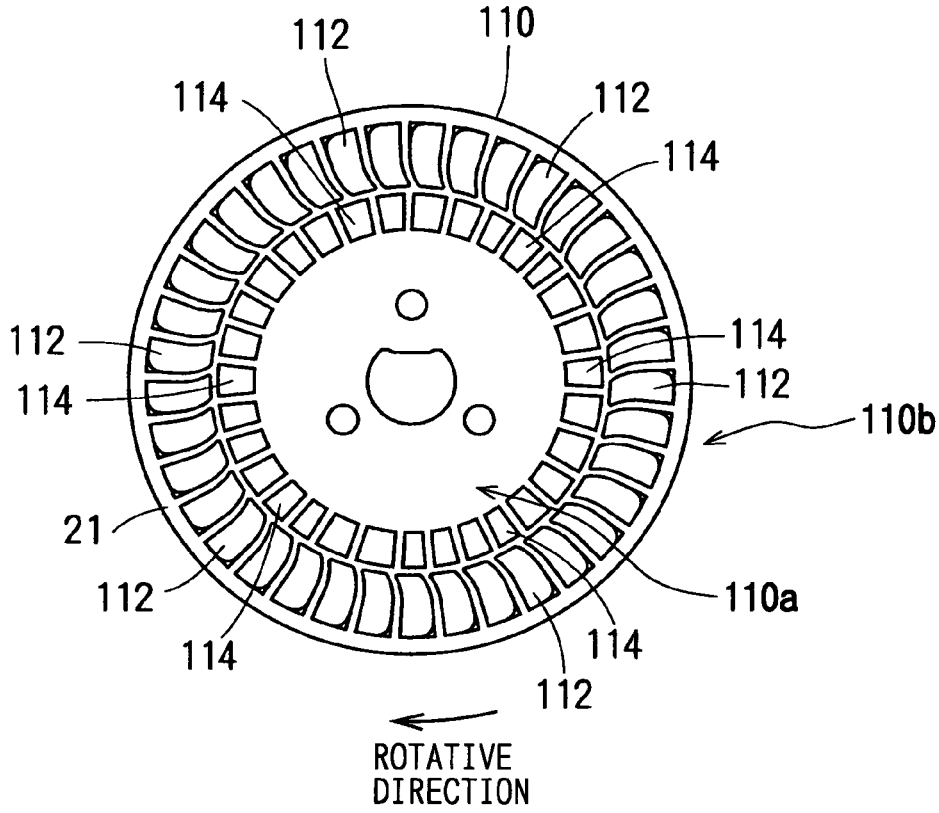
FIG. 5 is a front view showing an impeller when being viewed from the side of a fuel inlet of the fuel pump, according to a second embodiment of the present invention.
Figure 7:
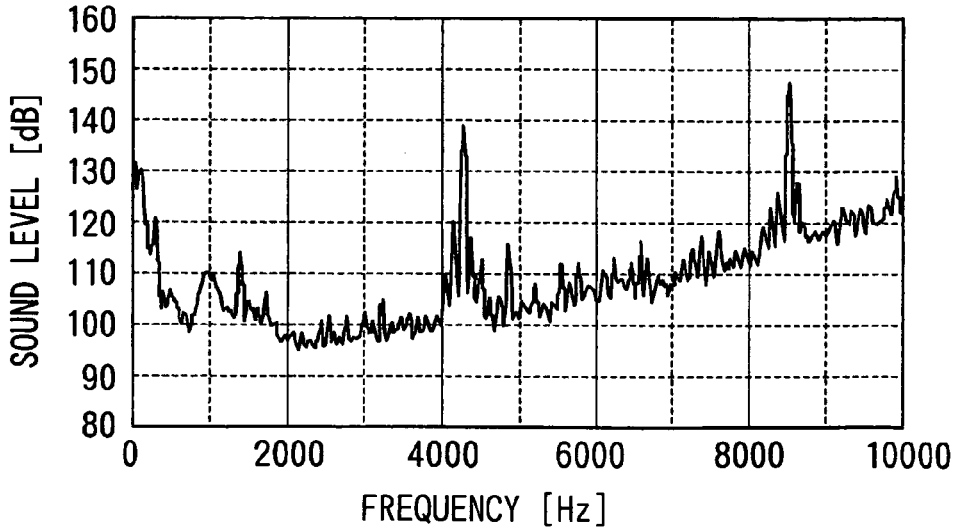
FIG. 7 is a graph showing a relationship between frequency and sound level of the example of the impeller.
Figure 6A:
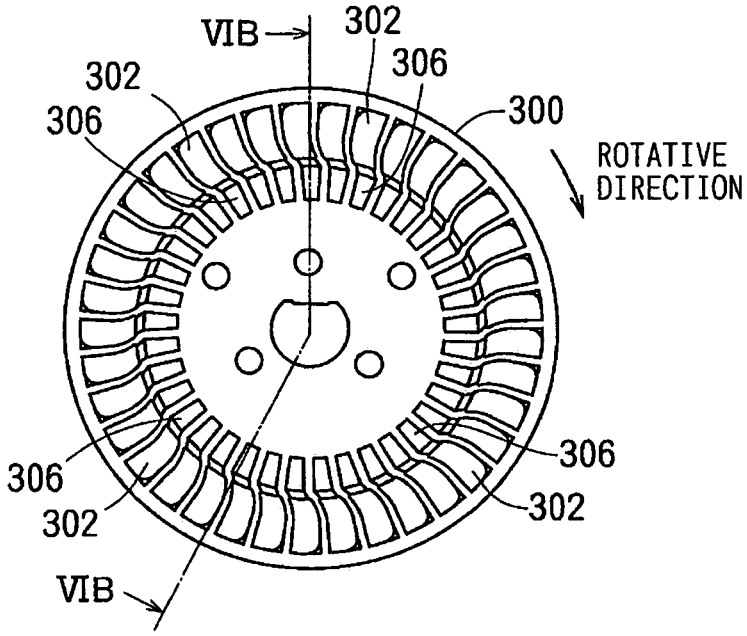
FIG. 6A PRIOR ART
FIG. 6A is a front view showing an example of an impeller when being viewed from the side of a fuel inlet of a fuel pump.
Figure 6B:
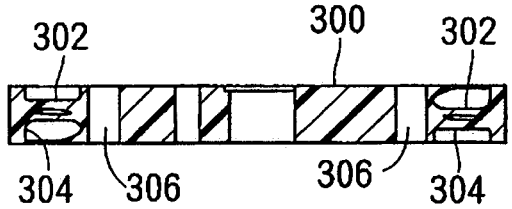
FIG. 6B PRIOR ART
FIG. 6B is a cross sectional side view taken along the line VIB-VIB in FIG. 6A.

As shown in FIG. 5, an impeller 110 includes an inner circumferential portion 110*a* and an outer circumferential portion 110*b*. The impeller 110 has vane grooves 112 and communication holes 114. The number of the vane grooves 112 is greater than the number of the communication holes 114 in this structure.

Other Embodiment

The communication holes can be formed on the side of the outer circumferential periphery of the vane grooves, instead of being formed on the side of the inner circumferential periphery of the vane grooves.

When the pitch of the communication holes in the rotative direction is set nonuniform, the width of the communication holes in the rotative direction may be set uniform. When the pitch of the communication holes in the rotative direction is set nonuniform, the number of the vane grooves may be set to be the same as the number of the communication holes.

In the above embodiments, the impeller is used in the pump portion of the fuel pump. However, the impeller is not limited to being applied to a fuel pump. The impeller can be used for pressuring fluid, so that the level of noise arising in pressurizing fuel can be reduced.

Various modifications and alternations may be diversely made to the above embodiments without departing from the spirit of the present invention.

What is claimed is:

1. An impeller that rotates for pressurizing fluid in a pump passage, the impeller comprising:

an inner circumferential portion; and an outer circumferential portion that is arranged on a radially outer side of the inner circumferential portion, the outer circumferential portion having two axial end surfaces with respect to an axial direction of the outer circumferential portion, each of the two axial end surfaces having a plurality of vane grooves arranged in a rotative direction of the outer circumferential portion, wherein one of the inner circumferential portion and the outer circumferential portion has a plurality of wall surfaces that axially extend straight through the one of the inner circumferential portion and the outer circumferential portion, the plurality of wall surfaces defining a plurality of communication holes that axially penetrate the one of the inner circumferential portion and the outer circumferential portion, the plurality of communication holes are displaced radially from the plurality of vane grooves, the plurality of communication holes are arranged substantially along the rotative direction at nonuniform pitches, and wherein the plurality of vane grooves is arranged at substantially uniform pitches in the rotative direction.

2. The impeller according to claim 1, wherein the one of the inner circumferential portion and the outer circumferential portion has a number of the plurality of communication holes, and the number of the plurality of communication holes is greater than a number of the plurality of vane grooves.

3. The impeller according to claim 1, wherein the plurality of communication holes is arranged on a side of an inner circumferential periphery of the plurality of vane grooves.

4. A fuel pump comprising:

the impeller according to claim 1; and a casing member that rotatably accommodates the impeller, the casing member having a fuel inlet, a fuel outlet, and pump passages, each of the pump passages extending from the fuel inlet to the fuel outlet, the pump passages being arranged on both sides of the two axial end surfaces of the outer circumferential portion, the pump passages respectively extending along the plurality of the vane grooves substantially in the rotative direction, wherein the impeller rotates for pumping fuel from the fuel inlet to the fuel outlet through the pump passages, in which fuel is pressurized, and fuel passes from one of the pump passages to an other of the pump passages through the plurality of communication holes of the impeller on the side of the fuel outlet in the pump passages.

5. An impeller apparatus comprising:

an impeller that includes an outer circumferential portion having two axial end surfaces with respect to an axial direction of the impeller, wherein each axial end surface has a plurality of vane grooves that are arranged in a rotative direction of the impeller, the impeller has a plurality of wall surfaces that axially extend straight through the impeller, the plurality of wall surfaces define a plurality of communication holes that axially penetrate the impeller, the plurality of communication holes are displaced radially from the plurality of vane grooves, and the plurality of communication holes are arranged substantially along the rotative direction at nonuniform pitches, the impeller apparatus further comprising:

a casing member that rotatably accommodates the impeller, wherein the casing member has pump passages, one pump passage axially opposing to one of the two axial end surfaces, an other pump passage axially opposing to an other of the two axial end surfaces, the pump passages respectively extend from an inlet to an outlet in the casing member along the plurality of the vane grooves substantially in the rotative directions and the plurality of vane grooves is arranged at substantially uniform pitches in the rotative direction.

6. The impeller apparatus according to claim 5, wherein the pump passages communicate with each other on a side of the inlet through the plurality of communication holes of the impeller, and the pump passages communicate with each other on a side of the outlet through the plurality of communication holes of the impeller.

7. The impeller apparatus according to claim 5, wherein the pump passages are partitioned from each other midway between the inlet and the outlet in the casing member.

8. The impeller apparatus according to claim 5, wherein the impeller has a number of the plurality of communication holes, and the number of the plurality of communication holes is greater than a number of the plurality of vane grooves.

9. The impeller apparatus according to claim 5, wherein the plurality of communication holes is arranged on a side of an inner circumferential periphery of the plurality of vane grooves.

10. The fuel pump according to claim 5, wherein the plurality of vane grooves in one of the two axial end surfaces is partitioned from the plurality of vane grooves in an other of the two axial end surfaces, the fuel inlet communicates with at least one of the plurality of communication holes, and the fuel outlet communicates with at least one of the plurality of communication holes.

11. The fuel pump according to claim 5, wherein the plurality of vane grooves in one of the two axial end surfaces is partitioned from the plurality of vane grooves in the other of the two axial end surfaces, the inlet communicates with at least one of the plurality of communication holes, and the outlet communicates with at least one of the plurality of communication holes.

* * * * *